US005773549A

United States Patent [19]

Moser et al.

[11] Patent Number: 5,773,549

[45] Date of Patent: Jun. 30, 1998

[54] PROCESS FOR HYDROTREATING AN ORGANIC FEEDSTOCK CONTAINING A HALOGENATED COMPONENT AND CONTAMINATED WITH DISTILLABLE OXYGEN AND NITROGEN COMPOUNDS HAVING BOILING POINTS LOWER THAN THE HALOGENATED COMPOUNDS

[75] Inventors: Mark D. Moser, Elk Grove Village; Tom N. Kalnes, La Grange; Chwu-Ching Jan, Elk Grove Village, all of Ill.

[73] Assignee: UOP LLC, Des Plaines, Ill.

[21] Appl. No.: 822,532

[22] Filed: Mar. 24, 1997

Related U.S. Application Data

[63] Continuation-in-part of Ser. No. 572,259, Dec. 13, 1995, abandoned, which is a continuation-in-part of Ser. No. 151,700, Nov. 15, 1993, abandoned.

[51] Int. Cl.[6] ..... C10G 45/02

[52] U.S. Cl. ..... 208/144; 208/262.1; 585/359; 585/464; 585/641; 585/733; 585/802

[58] Field of Search ..... 585/464, 359, 585/469, 641, 733, 2; 208/144, 262.1

[56] References Cited

U.S. PATENT DOCUMENTS 4,818,368 4/1989 Kalnes et al. ..... 208/50
4,882,037 11/1989 Kalnes et al. ..... 208/85
4,923,590 5/1990 Kalnes et al. ..... 208/85
5,354,931 10/1994 Jan et al. ..... 585/264

*Primary Examiner*—Helane Myers
*Attorney, Agent, or Firm*—Thomas K. McBride; John G. Tolomei; John G. Cutts, Jr.

[57] ABSTRACT

The invention provides a process for hydrotreating an organic feedstock containing a halogenated component and contaminated with distillable oxygen compounds, and/or distillable nitrogen compounds having boiling points lower than the halogenated compounds by means of removing the distillable oxygen compounds and distillable nitrogen compounds with a fractionation zone and then contacting the resulting organic feedstock having a reduced concentration of distillable oxygen and nitrogen compounds and a gaseous recycle stream containing hydrogen with a hydrogenation catalyst in a hydrogenation reaction zone to produce an anhydrous liquid stream comprising hydrogenated hydrocarbonaceous compounds having a reduced concentration of organic halide and a hydrogen halide compound. The resulting effluent from the hydrogenation zone is optionally separated to produce a hydrogenated hydrocarbonaceous stream having a reduced level of halogen and an anhydrous stream comprising a hydrogen halide compound.

13 Claims, 1 Drawing Sheet

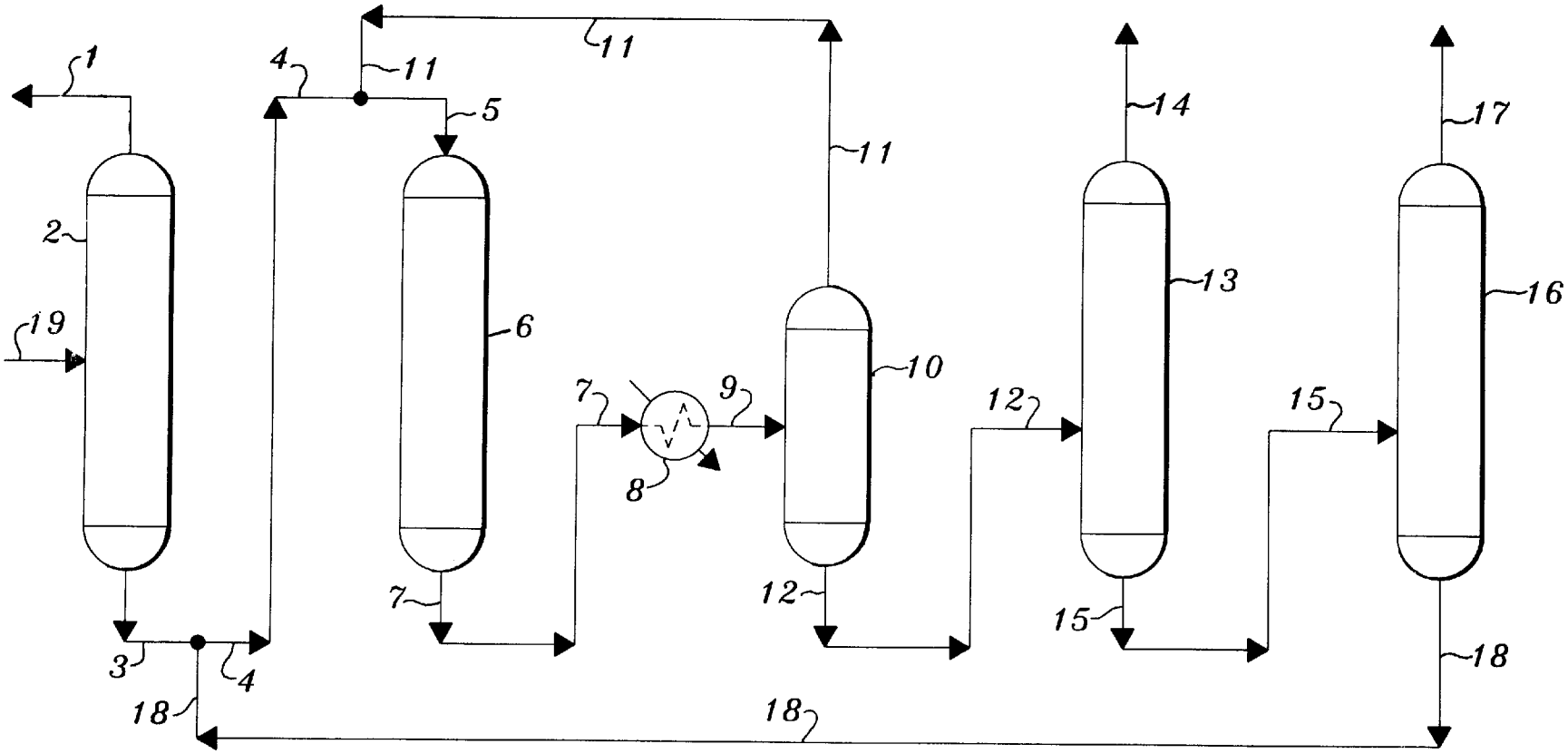
1
2
19
3
4
18
4
11
5
6
7
7
8
9
10
11
12
12
13
14
15
15
16
17
18

PROCESS FOR HYDROTREATING AN ORGANIC FEEDSTOCK CONTAINING A HALOGENATED COMPONENT AND CONTAMINATED WITH DISTILLABLE OXYGEN AND NITROGEN COMPOUNDS HAVING BOILING POINTS LOWER THAN THE HALOGENATED COMPOUNDS

CROSS REFERENCE TO RELATED APPLICATION

The present application is a continuation-in-part application of U.S. Ser. No. 08/572,259 filed on Dec. 13, 1995, now abandoned which is a continuation-in-part application of U.S. Ser. No. 08/151,700 filed on Nov. 15, 1993, both of which are incorporated by reference and now abandoned.

BACKGROUND OF THE INVENTION

The field of art to which this invention pertains is the conversion of an organic feedstock containing a halogen component and contaminated with oxygen compounds and/or nitrogen compounds to produce hydrocarbonaceous compounds having a reduced concentration of organic halide.

There has always been a demand for the conversion or disposal of waste or by-product streams which originate in the petroleum, chemical and petrochemical industries. More particularly, these by-products originate from the chlorination of olefins in the production of allyl chloride, epichlorohydrin, propylene chlorohydrin, propylene oxide, ethylene dichloride and vinyl chloride monomers, for example. It is common in such streams for the predominate species to be halogenated alkanes, but, in addition, in some cases, there are present distillable oxygen compounds having a boiling point lower than the halogenated compounds such as aldehydes and ketones, for example, that can subsequently decompose to water during subsequent processing, thereby leading to the undesirable corrosion of the reactor and its associated piping. This production of water can lead to the formation of corrosive aqueous solutions and the contamination of any desired anhydrous hydrogen halide product streams. Distillable nitrogen compounds having a boiling point lower than the halogenated compounds may also be present such as nitrites, for example, which may subsequently decompose to compounds which complicate the process by fouling and plugging of the processing equipment. Previous techniques utilized to dispose of waste streams containing halogen components, oxygen compounds, nitrogen compounds and other heteroatomic compounds have frequently become environmentally unpopular or illegal and, in general, have always been expensive. With the increased environmental emphasis for the treatment and recycle of halogenated organic compounds, there is an increased need for the conversion of these products when they become unwanted. Therefore, those skilled in the art have sought to find feasible techniques to convert such feedstocks to provide hydrocarbonaceous product streams having a reduced concentration of halogen which may be safely and usefully employed or recycled. Previous techniques which have been employed include incineration and dumping which, in addition to potential pollution considerations, fail to recover valuable hydrocarbonaceous materials and the resulting halogen compounds.

Recently the prior art has disclosed various processes for the conversion of halogenated organic streams to dispose of the streams, to produce hydrocarbons and halides, to recycle valuable raw materials, or a combination thereof. However, at least some of the halogenated organic streams which are candidates for conversion have been discovered to contain small quantities of distillable oxygen compounds and nitrogen compounds having a boiling point lower than the halogenated compounds. Although the nitrogen and oxygen compounds are present in small quantities, for example, less than about 1–2 weight percent, their presence greatly complicates the conversion of the halogenated organic compounds and may even preclude the conversion completely.

The prior art teaches that oxygen compounds may be removed from organic feedstocks containing oxygen compounds and a halogen component by contact with an adsorbent to produce a feedstock having a reduced concentration of oxygen compounds. The disadvantage to this approach includes the eventual disposal of the spent adsorbent containing oxygen compounds or the regeneration of the spent adsorbent. A successful process has been unexpectedly discovered which successfully hydrotreats an organic feedstock containing a halogenated component and contaminated with distillable oxygen and nitrogen compounds having boiling points lower than the halogenated compounds without the disadvantage of using an adsorbent to remove the deleterious oxygen compounds from the halogenated organic feedstock.

INFORMATION DISCLOSURE

In U.S. Pat. No. 4,818,368 (Kalnes et al), a process is disclosed for treating a temperature-sensitive hydrocarbonaceous stream containing a non-distillable component to produce a hydrogenated distillable hydrocarbonaceous product while minimizing the degradation of the hydrocarbonaceous stream.

In U.S. Pat. No. 4,882,037 (Kalnes et al), a process is disclosed for treating a temperature-sensitive hydrocarbonaceous stream containing a non-distillable component and a distillable, hydrogenatable hydrocarbonaceous fraction to produce a selected hydrogenated distillable light hydrocarbonaceous product, a distillable heavy hydrocarbonaceous liquid product and a heavy product.

In U.S. Pat. No. 4,923,590 (Kalnes et al), a process is disclosed wherein the effluent from a hydrogenation reaction zone is contacted with an aqueous scrubbing solution. In one embodiment, the '590 patent teaches that when the feed to the hydrogenation zone comprises halogenated compounds, the aqueous scrubbing solution preferably contains a basic compound to neutralize the acid.

In U.S. Pat. No. 5,354,931 (Jan et al), a process is disclosed for hydrotreating an organic feedstock containing oxygen compounds and a halogen component by means of removing the oxygen compounds with an adsorbent and then contacting the resulting organic feedstock having a reduced concentration of oxygen compounds and a gaseous recycle stream containing hydrogen with a hydrogenation catalyst in a hydrogenation reaction zone to produce an anhydrous liquid stream comprising hydrogenated hydrocarbonaceous compounds having a reduced concentration of halogen and a hydrogen halide compound.

BRIEF SUMMARY OF THE INVENTION

The present invention provides a process for hydrotreating an organic feedstock containing a halogen component and contaminated with distillable oxygen compounds and/or distillable nitrogen compounds having boiling points lower than the halogenated compounds by means of removing the oxygen compounds and nitrogen compounds in the overhead stream of a stripping or fractionation zone and subsequently contacting the resulting organic feed having a reduced level of oxygen and nitrogen compounds and a gaseous recycle stream containing hydrogen with a hydrogenation catalyst in a hydrogenation reaction zone to produce an anhydrous liquid stream comprising hydrogenated hydrocarbonaceous compounds having a reduced concentration of halogen and a hydrogen halide compound. The resulting effluent from the hydrogenation zone is separated to produce a hydrogen-rich gaseous recycle stream. Important elements of the improved process are the essentially complete elimination of water in the effluent from the hydrogenation zone, the ability to achieve longer run lengths and catalyst life, the use of more economical metallurgy in the processing plant and the elimination of the expense and operation of adsorbent zones for the separation of the undesirable oxygen compounds from the feedstock. In addition to these operating advantages, valuable products including hydrogenated hydrocarbonaceous compounds and hydrogen halide compounds are produced while simultaneously converting unwanted by-products or wastes to thereby solve a potential pollution problem.

One embodiment of the invention may be characterized as a process for treating a halogenated organic stream containing at least one distillable compound having a boiling point lower than the halogenated compounds contained in the halogenated organic stream and selected from the group consisting of an oxygen compound and a nitrogen compound to produce an anhydrous liquid stream comprising hydrogenated hydrocarbonaceous compounds and a hydrogen halide compound which process comprises the steps of: (a) fractionating the halogenated organic stream containing at least one distillable compound having a boiling point lower than the halogenated compounds contained in the halogenated organic stream and selected from the group consisting of an oxygen compound and a nitrogen compound to produce a halogenated organic stream having a reduced concentration of oxygen and nitrogen compounds and a stream comprising at least one distillable compound having a boiling point lower than the halogenated compounds contained in the halogenated organic stream and selected from the group consisting of oxygen compounds and nitrogen compounds; (b) contacting the halogenated organic stream having a reduced concentration of oxygen and nitrogen compounds produced in step (a) and a hydrogen-rich, gaseous recycle stream with a hydrogenation catalyst in a hydrogenation reaction zone at hydrogenation reaction conditions to increase the hydrogen content of the halogenated organic stream having a reduced concentration of oxygen and nitrogen compounds and to thereby produce a hydrogen halide compound; and (c) condensing at least a portion of the resulting effluent from the hydrogenation reaction zone to produce the hydrogen-rich, gaseous recycle stream and an anhydrous liquid stream comprising hydrogenated hydrocarbonaceous compounds and a hydrogen halide compound.

Another embodiment of the invention may be characterized as a process for treating a halogenated organic stream containing at least one distillable compound having a boiling point lower than the halogenated compounds contained in the halogenated organic stream and selected from the group consisting of an oxygen compound and a nitrogen compound to produce a hydrogenated hydrocarbonaceous stream having a reduced level of halogen and an anhydrous stream comprising a hydrogen halide compound which process comprises the steps of: (a) fractionating the halogenated organic stream containing at least one distillable compound having a boiling point lower than the halogenated compounds contained in the halogenated organic stream and selected from the group consisting of an oxygen compound and a nitrogen compound to produce a halogenated organic stream having a reduced concentration of oxygen and nitrogen compounds and a stream comprising at least one distillable compound having a boiling point lower than the halogenated compounds contained in the halogenated organic stream and selected from the group consisting of oxygen compounds and nitrogen compounds; (b) contacting the halogenated organic stream having a reduced concentration of oxygen and nitrogen compounds produced in step (a) and a hydrogen-rich, gaseous recycle stream with a hydrogenation catalyst in a hydrogenation reaction zone at hydrogenation reaction conditions to increase the hydrogen content of the halogenated organic stream having a reduced concentration of oxygen and nitrogen compounds and to thereby produce a hydrogen halide compound; (c) condensing at least a portion of the resulting effluent from the hydrogenation reaction zone to produce the hydrogen-rich, gaseous recycle stream and a liquid stream comprising hydrogenated hydrocarbonaceous compounds and a hydrogen halide compound; and (d) separating the liquid stream comprising hydrogenated hydrocarbonaceous compounds and a hydrogen halide compound to produce an anhydrous stream comprising a hydrogen halide compound and a stream comprising hydrogenated hydrocarbonaceous compounds.

Yet another embodiment of the invention may be characterized as a process for treating a halogenated organic stream containing at least one distillable compound having a boiling point lower than the halogenated compounds contained in the halogenated organic stream and selected from the group consisting of an oxygen compound and a nitrogen compound to produce an anhydrous liquid stream comprising hydrogenated hydrocarbonaceous compounds and a hydrogen halide compound which process comprises the steps of: (a) fractionating the halogenated organic stream containing at least one distillable compound having a boiling point lower than the halogenated compounds contained in the halogenated organic stream and selected from the group consisting of an oxygen compound and a nitrogen compound to produce a halogenated organic stream having a reduced concentration of oxygen and nitrogen compounds and a stream comprising at least one distillable compound having a boiling point lower than the halogenated compounds contained in the halogenated organic stream and selected from the group consisting of oxygen compounds and nitrogen compounds; (b) contacting the halogenated organic stream having a reduced concentration of oxygen and nitrogen compounds produced in step (a), a hydrogen-rich, gaseous recycle stream and a recycle stream comprising unreacted halogenated organic compounds with a hydrogenation catalyst in a hydrogenation reaction zone at hydrogenation reaction conditions to increase the hydrogen content of the halogenated organic stream and to thereby produce a hydrogen halide compound; (c) condensing at least a portion of the resulting effluent from the hydrogenation reaction zone to produce the hydrogen-rich, gaseous recycle stream and a liquid stream comprising hydrogenated hydrocarbonaceous compounds and a hydrogen halide compound; (d) separating the liquid stream comprising hydrogenated hydrocarbonaceous compounds and a hydrogen halide compound to produce an anhydrous stream comprising a hydrogen halide compound and a stream comprising hydrogenated hydrocarbonaceous compounds and unreacted halogenated organic compounds; and (e) separating the stream comprising hydrogenated hydrocarbonaceous compounds and unreacted halogenated organic compounds to produce the recycle stream comprising unreacted halogenated organic compounds and the hydrogenated hydrocarbonaceous stream having a reduced level of halogen.

BRIEF DESCRIPTION OF THE DRAWING

The drawing is a simplified process flow diagram of a preferred embodiment of the present invention.

DETAILED DESCRIPTION OF THE INVENTION

The present invention provides an improved integrated process for hydrotreating an organic feedstock containing a halogen component and contaminated with distillable oxygen compounds and/or distillable nitrogen compounds having boiling points lower than the halogenated compounds while eliminating or at least minimizing the production of water during processing and thereby minimizing the production of corrosive aqueous solutions in the process plant and permitting the production of anhydrous hydrogen halide product. In addition, once the introduction of distillable nitrogen compounds into the hydrogenation zone is precluded, the hydrogenation zone effluent contains no nitrogen compounds which would complicate the recovery and separation of the components of the hydrogenation zone effluent. There is a steadily increasing demand for technology which is capable of converting or hydrotreating an organic feedstock containing a halogen component and, in particular, for a process which is capable of processing such a stream which, in addition, contains distillable oxygen compounds and/or nitrogen compounds having boiling points lower than the halogenated compounds. In accordance with the present invention, it has been unexpectedly discovered that the distillable oxygen compounds and nitrogen compounds having boiling points lower than the halogenated compounds may be selectively removed from an organic feedstock containing halogen compounds, oxygen compounds and nitrogen compounds without the undesirable conversion of the halogen compounds during the removal of the oxygen and nitrogen compounds.

A wide variety of halogenated organic compounds containing distillable oxygen and nitrogen compounds having boiling points lower than the halogenated compounds are candidates for feed streams in accordance with the process of the present invention. Examples of organic streams comprising halogenated organic compounds which are suitable for treatment by the process of the present invention are dielectric fluids, hydraulic fluids, heat transfer fluids, used lubricating oil, used cutting oils, used solvents, halogenated hydrocarbonaceous by-products, oils contaminated with polychlorinated biphenyls (PCB), halogenated wastes, by-products from the manufacture of vinyl chloride monomer, propylene oxide, allyl chloride, epichlorohydrin and other halogenated intermediates and final products, petrochemical by-products and other halogenated hydrocarbonaceous industrial wastes. Often, in a particular place or location, two or more halogenated organic streams are present and require further treatment. The halogenated organic compounds may also contain hydrogen and are therefore then referred to as hydrocarbonaceous compounds. The halogenated organic feed to the present process preferably contains distillable oxygen and nitrogen compounds having boiling points lower than the halogenated compounds in an amount from about 20 to about 20,000 weight ppm. The halogenated organic feed also preferably contains halogenated organic compounds in an amount from about 50 to about 99 weight percent.

Preferred feedstocks comprise a component selected from the group consisting of fractionation column bottoms from the production of allyl chloride, fractionation column bottoms from the production of ethylene dichloride, by-products from the manufacture of vinyl chloride monomer, fractionation column bottoms from the production of trichloroethylene and perchloroethylene, used dielectric fluid containing polychlorinated biphenyls (PCB) and halogenated benzene, used solvents, fractionation bottoms from the purification column in epichlorohydrin production, carbon tetrachloride, 1,1,1-trichloroethane, halogenated alcohols, halogenated ethers, chlorofluorocarbons and admixtures thereof.

The process of the present invention is most advantageously utilized when the feedstock contains distillable oxygen compounds having boiling points lower than the halogenated compounds which have a marked tendency to be converted to water when subjected to a hydrogenation zone in the presence of hydrogen. In accordance with the present invention, the halogenated organic feedstock preferably contains from about 20 to about 10,000 weight ppm of distillable oxygen compounds or water precursors. It is preferred that the distillable oxygen compounds are selected from the group consisting of water, aldehydes, ketones, alcohols, epoxides and ethers. In one embodiment of the present invention, the resulting hydrogen halide may be conveniently recovered as an anhydrous hydrogen halide stream and, as used herein, the term "anhydrous stream comprising hydrogen halide" connotes a stream having less than about 50 ppm by weight of water.

The process of the present invention is also most advantageously used when the feedstock contains distillable nitrogen compounds having boiling points lower than the halogenated compounds which have a tendency to be converted to ammonia and ammonium chloride when subjected to a hydrogenation zone in the presence of hydrogen and chlorine. In accordance with the present invention, the halogenated organic feedstock preferably contains from about 20 to about 10,000 weight ppm distillable nitrogen compounds. It is preferred that distillable nitrogen compounds are selected from the group consisting of organonitrile, organonitric, organonitro, organonitrous, organonitroso, organoamide, organoamine compounds and heterocyclic nitrogen compounds. In the event that the halogenated organic feed stream contains both distillable oxygen compounds and distillable nitrogen compounds, it is preferred that the combined concentration of distillable oxygen and nitrogen compounds is from about 20 to about 20,000 weight ppm.

The halogenated organic compounds which are contemplated as feedstocks in the present invention may contain a halogen selected from the group consisting of chlorine, bromine, fluorine and iodine. Preferred halogen compounds contain a halogen selected from the group consisting of chlorine, bromine and fluorine. In addition, the halogenated organic compounds preferably contain from 1 to about 20 carbon atoms per molecule.

In accordance with the present invention, a halogenated organic feedstock containing distillable oxygen and nitrogen compounds is separated to produce a halogenated organic stream having a reduced concentration of distillable oxygen and nitrogen compounds and a stream comprising the separated distillable oxygen and nitrogen compounds. The separation may be selected from the group consisting of evaporation, fractionation and stripping. The required separation conditions will depend on the evaporator, fractionator or stripper which is selected together with the particular halogenated organic feed stream which is available. A general range of suitable separation conditions includes vacuum to less than about 750 psig (5171 kPa gauge), although higher pressures may be employed, and a temperature less than about 200° F. (93° C.). Since it is contemplated that the halogenated organic feed stream will contain only relatively small quantities of distillable oxygen and nitrogen compounds, the resulting separated stream containing the distillable oxygen and nitrogen compounds is expected to be small and preferably less than about 5 weight percent of the feed and more preferably less than about 2 weight percent of the feed.

In accordance with the present invention, a resulting stream containing halogenated organic compounds and having a reduced concentration of distillable oxygen and nitrogen compounds is introduced in admixture with a hydrogen-rich, gaseous recycle stream and, optionally, a recycle stream comprising unreacted halogenated organic compounds into a catalytic hydrogenation zone containing hydrogenation catalyst and maintained at hydrogenation conditions. This catalytic hydrogenation zone may contain a fixed, ebullated or fluidized catalyst bed. Moreover, the hydrogenation reaction zone may consist of multiple catalyst beds operated at various conditions. This reaction zone is preferably maintained at conditions which are chosen to dehalogenate the halogenated organic compounds which are introduced thereto. The catalytic hydrogenation zone is preferably maintained under an imposed pressure from about atmospheric to about 2000 psig and more preferably under a pressure from about 100 psig to about 1800 psig. Suitably, such reaction is conducted with a maximum catalyst bed temperature in the range of about 50° F. (10° C.) to about 850° F. (454° C.) selected to perform the desired dehalogenation conversion to reduce or eliminate the concentration of halogenated organic compounds contained in the feed stream. In accordance with the present invention, it is contemplated that the desired hydrogenation conversion includes, for example, olefin saturation, dehalogenation, aromatic saturation and hydrocracking. In addition, the effluent from the hydrogenation zone contains essentially no thermally unstable compounds which may be deleterious to any other further processing steps. Further preferred operating conditions include liquid hourly space velocities in the range from about 0.05 $hr^{-1}$ to about 20 $hr^{-1}$ and hydrogen circulation rates from about 200 standard cubic feet per barrel (SCFB) to about 150,000 SCFB, preferably from about 200 SCFB to about 100,000 SCFB.

As used in the present invention, the term "hydrotreating" or "hydrogenation" is meant to include reactions whereby the organic reactants achieve an increased hydrogen content, regardless of whether this is achieved by olefin saturation, diolefin saturation, or dehalogenation, for example.

The preferred catalytic composite disposed within the hereinabove-described hydrogenation zone can be characterized as containing a metallic component having hydrogenation activity, which component is combined with a suitable refractory carrier material of either synthetic or natural origin. The precise composition and method of manufacturing the carrier material is not considered essential to the present invention. Preferred carrier materials are alumina, silica, carbon and mixtures thereof. Suitable metallic components having hydrogenation activity are those selected from the group comprising the metals of Groups VIB and VIII of the Periodic Table, as set forth in the *Periodic Table of Elements,* E. H. Sargent and Company, 1964. Thus, the catalytic composite may comprise one or more metallic components from the group of molybdenum, tungsten, chromium, iron, cobalt, nickel, platinum, palladium, iridium, osmium, rhodium, ruthenium, and mixtures thereof. The concentration of the catalytically active metallic component, or components, is primarily dependent upon a particular metal as well as the physical and/or chemical characteristics of the particular hydrocarbon feedstock. For example, the metallic components of Group VIB are generally present in an amount within the range of from about 1 to about 20 weight percent, the iron-group metals in an amount within the range of about 0.2 to about 10 weight percent, whereas the noble metals of Group VIII are preferably present in an amount within the range of from about 0.1 to about 5 weight percent, all of which are calculated as if these components existed within the catalytic composite in the elemental state. It is further contemplated that hydrogenation catalytic composites may comprise one or more of the following components: cesium, francium, lithium, potassium, rubidium, sodium, copper, gold, silver, cadmium, mercury and zinc. Preferred hydrogenation catalysts comprise alumina and palladium.

In accordance with the present invention, the hydrocarbonaceous effluent containing at least one hydrogen halide compound from the hydrogenation zone is cooled and introduced into a vapor-liquid separator to produce a hydrogen-rich, gaseous recycle stream and a liquid stream comprising hydrogenated hydrocarbonaceous compounds and hydrogen halide compounds. In accordance with the present invention, it is contemplated that the vapor-liquid separator is preferably operated at a pressure between about 400 and about 1800 psig and at a temperature from about −70° F. (−57° C.) to about 60° F. (16° C.). In one embodiment of the present invention, the resulting liquid stream comprising hydrogenated hydrocarbonaceous compounds and hydrogen halide compounds is separated to produce an anhydrous stream comprising hydrogen halide compounds and a liquid stream comprising hydrogenated hydrocarbonaceous compounds. This second resulting liquid stream is then optionally separated to produce a recycle stream comprising any unreacted halogenated organic compounds which is optionally introduced into the hydrogenation reaction zone and a hydrogenated hydrocarbonaceous stream having a reduced level of halogen. In accordance with one embodiment of the present invention, the hydrogen halide compound is recovered as an anhydrous product stream. This permits the subsequent recovery and use of a desirable and valuable hydrogen halide compound.

In the drawing, the process of the present invention is illustrated by means of a simplified flow diagram in which such details as total number of reaction zone and drier vessels, pumps, instrumentation, heat-exchange and heat-recovery circuits, compressors and similar hardware have been deleted as being non-essential to an understanding of the techniques involved. The use of such miscellaneous appurtenances are well within the purview of one skilled in the art.

DETAILED DESCRIPTION OF THE DRAWING

With reference now to the drawing, a halogenated organic feed stream containing distillable nitrogen and oxygen compounds having boiling points lower than the halogenated compounds is introduced into the process via conduit 19 and is passed into fractionation zone 2 in order to produce a stream containing at least a portion of the distillable oxygen and nitrogen compounds contained in the feed stream which is recovered via conduit 1. A resulting halogenated organic stream having a reduced concentration of distillable oxygen and nitrogen compounds having boiling points lower than the halogenated compounds is removed from fractionation zone 2 via conduit 3 and admixed with an optional hereinafter-described liquid recycle stream provided via conduit 18. The resulting admixture is transported via conduit 4 and is admixed with a hereinafter-described hydrogen-rich gaseous recycle stream provided via conduit 11. This resulting admixture is introduced via conduit 5 into hydrogenation zone 6. The resulting hydrogenated organic stream is removed from the hydrogenation reaction zone 6 via conduit 7, is cooled in heat exchanger 8 and introduced into vapor-liquid separator 10 via conduit 9. A hydrogen-rich gaseous stream is removed from vapor-liquid separator 10 via conduit 11 and recycled as described hereinabove. Since hydrogen is lost in the process by means of a portion of the hydrogen being dissolved in the exiting liquid hydrocarbon and hydrogen being consumed during the hydrogenation reaction, it is necessary to supplement the hydrogen-rich gaseous stream with makeup hydrogen from some suitable external source, for example, a catalytic reforming unit or a hydrogen plant. Makeup hydrogen may be introduced into the system at any convenient and suitable point which is not shown on the drawing. A liquid hydrogenated hydrocarbonaceous stream containing hydrogen and a hydrogen halide in solution is removed from vapor-liquid separator 10 via conduit 12 and is introduced into fractionation zone 13. A product stream containing a hydrogen halide is removed from fractionation zone 13 via conduit 14 and recovered. A liquid distillable hydrogenated hydrocarbonaceous stream is optionally removed from fractionation zone 13 via conduit 15 and introduced into fractionation zone 16. A product stream containing hydrocarbonaceous compounds having a reduced concentration of halogen is removed from fractionation zone 16 via conduit 17 and recovered. A liquid stream containing unconverted organic compounds containing halogen is removed from fractionation zone 16 via conduit 18 and is recycled to hydrogenation reaction zone 6 via conduit 18 as described hereinabove.

ILLUSTRATIVE EMBODIMENT

This illustrative embodiment demonstrates the efficacy of processing a halogenated waste stream containing 30 weight percent allyl chloride by-product and 70 weight percent propylene oxide by-product in an amount of 100 mass units. The characteristics of the halogenated waste stream are presented in Table 1. The halogenated waste stream is fractionated to yield an overhead stream in an amount of 2.4 mass units and containing a large percentage of the distillable oxygen and nitrogen compounds having boiling points lower than the halogenated compounds.

The bottom stream from the fractionation zone in an amount of 97.6 mass units is sampled, analyzed and found to have the characteristics presented in Table 1.

TABLE 1

COMPOSITION ANALYSIS

| Compound | Fresh Feed Mass, % or PPM | Hydrogenation Zone Feed Mass, % or PPM |
|---|---|---|
| Propanal | 500 ppm | <10 ppm |
| $H_2O$ | 200 ppm | <100 ppm |
| Acetonitrile | 100 ppm | <10 ppm |
| Chloropropene | <1% | <1% |
| Dichloropropane | 90% | 90% |
| Benzene | <1% | <1% |
| Dichloropropene | 8% | 8% |

The resulting fractionation zone bottom stream is contacted in a hydrogenation/dechlorination zone with a catalyst containing alumina and palladium at hydrogenation conditions which include a pressure of about 750 psig, a catalyst temperature of about 300° F. and a chloride conversion of 99.9 weight percent. After 1200 hours of operation, the activity, stability and selectivity remain essentially constant. The mechanical equipment associated with the process work reliably and without a problem during this time period. This operation is continuous with no required downtime for maintenance and no signs of corrosion in spite of the elevated hydrogen chloride concentrations throughout the process plant. There is also no sign of deposits containing nitrogen compounds. The results of the hydrogenation/dechlorination are summarized and presented in Table 2.

TABLE 2

HYDROGENATION/DECHLORINATION SUMMARY

| Operating Conditions | |
|---|---|
| Pressure, psig | 750 |
| Catalyst Temperature, °F. | 300 |
| Chloride Conversion, weight percent | >99.9 |
| Feed Water Content, wppm | 25 |
| Weight Hourly Space Velocity, $hr^{-1}$ | 0.3 |

In the event that the feed to the catalytic zone contained higher levels of water and distillable organic oxygen compounds, it could be expected that significant corrosion could occur to both the inorganic oxide catalyst support and the piping downstream of the reactor effluent at points where the feed water and the water resulting from the reaction (organic oxygen compounds are converted to water in the catalytic conversion zone) condense. Corrosion of the catalyst support leads to both loss of catalytic surface area and ultimately the leaching of the catalytic metal, both of which result in loss of conversion performance. Therefore, the conversion performance would not be stable under these conditions. In addition, corrosion of piping and equipment downstream of the reactor would have ultimately resulted in equipment failure and operational downtime. In addition, the lack of nitrogen compound deposits indicates long run life without any plugging of the process equipment.

The foregoing description, drawing and illustrative embodiment clearly illustrate the advantages encompassed by the process of the present invention and the benefits to be afforded with the use thereof.

What is claimed:

1. A process for treating a halogenated organic stream containing at least one distillable compound having a boiling point lower than the halogenated compounds contained in said halogenated organic stream and selected from the group consisting of an oxygen compound and a nitrogen compound to produce an anhydrous liquid stream comprising hydrogenated hydrocarbonaceous compounds and a hydrogen halide compound which process comprises the steps of:

(a) fractionating said halogenated organic stream containing at least one distillable compound having a boiling point lower than the halogenated compounds contained in said halogenated organic stream and selected from the group consisting of an oxygen compound and a nitrogen compound to produce a halogenated organic stream having a reduced concentration of oxygen and nitrogen compounds and a stream comprising at least one distillable compound having a boiling point lower than the halogenated compounds contained in said halogenated organic stream and selected from the group consisting of oxygen compounds and nitrogen compounds;

(b) contacting said halogenated organic stream having a reduced concentration of oxygen and nitrogen compounds produced in step (a) and a hydrogen-rich, gaseous recycle stream with a hydrogenation catalyst in a hydrogenation reaction zone at hydrogenation reaction conditions to increase the hydrogen content of said halogenated organic stream having a reduced concentration of oxygen and nitrogen compounds and to thereby produce a hydrogen halide compound; and (c) condensing at least a portion of the resulting effluent from said hydrogenation reaction zone to produce said hydrogen-rich, gaseous recycle stream and an anhydrous liquid stream comprising hydrogenated hydrocarbonaceous compounds and a hydrogen halide compound.

2. The process of claim 1 wherein said halogenated organic stream contains compounds having from 1 to about 20 carbon atoms per molecule.

3. The process of claim 1 wherein said halogenated organic stream contains halogenated organic compounds in an amount from about 50 to about 99 weight percent.

4. The process of claim 1 wherein said oxygen compound is selected from the group consisting of water, aldehydes, ketones, alcohols, epoxides and ethers.

5. The process of claim 1 wherein said oxygen compound is present in an amount from about 20 to about 10,000 weight ppm.

6. The process of claim 1 wherein said nitrogen compound is selected from the group consisting of organonitrile, organonitric, organonitro, organonitrous, organonitroso, organoamide, organoamine compounds and heterocyclic nitrogen compounds.

7. The process of claim 1 wherein said nitrogen compound is present in an amount from about 20 to 10,000 weight ppm.

8. The process of claim 1 wherein said hydrogenation catalyst comprises a Group VIII metal on a refractory inorganic oxide support.

9. The process of claim 1 wherein said hydrogenation catalyst comprises palladium and alumina.

10. The process of claim 1 wherein said hydrogenation zone is operated at hydrogenation reaction conditions including a temperature from about 50° F. (10° C.) to about 850° F. (454° C.), a pressure from about 100 psig to about 1800 psig and a hydrogen circulation rate from about 200 SCFB to about 150,000 SCFB.

11. The process of claim 1 wherein said halogenated organic stream comprises a component selected from the group consisting of fractionation bottoms from the production of allyl chloride, ethylene dichloride, trichloroethylene, epichlorohydrin and perchloroethylene; by-products from the manufacture of vinyl chloride monomer and propylene oxide, used dielectric fluid containing polychlorinated biphenyls, halogenated benzene, carbon tetrachloride, 1,1,1-trichloroethane, halogenated alcohols, halogenated ethers, chlorofluorocarbons and admixtures thereof.

12. A process for treating a halogenated organic stream containing at least one distillable compound having a boiling point lower than the halogenated compounds contained in said halogenated organic stream and selected from the group consisting of an oxygen compound and a nitrogen compound to produce a hydrogenated hydrocarbonaceous stream having a reduced level of halogen and an anhydrous stream comprising a hydrogen halide compound which process comprises the steps of:

(a) fractionating said halogenated organic stream containing at least one distillable compound having a boiling point lower than the halogenated compounds contained in said halogenated organic stream and selected from the group consisting of an oxygen compound and a nitrogen compound to produce a halogenated organic stream having a reduced concentration of oxygen and nitrogen compounds and a stream comprising at least one distillable compound having a boiling point lower than the halogenated compounds contained in said halogenated organic stream and selected from the group consisting of oxygen compounds and nitrogen compounds;

(b) contacting said halogenated organic stream having a reduced concentration of oxygen and nitrogen compounds produced in step (a) and a hydrogen-rich, gaseous recycle stream with a hydrogenation catalyst in a hydrogenation reaction zone at hydrogenation reaction conditions to increase the hydrogen content of said halogenated organic stream having a reduced concentration of oxygen and nitrogen compounds and to thereby produce a hydrogen halide compound;

(c) condensing at least a portion of the resulting effluent from said hydrogenation reaction zone to produce said hydrogen-rich, gaseous recycle stream and a liquid stream comprising hydrogenated hydrocarbonaceous compounds and a hydrogen halide compound; and (d) separating said liquid stream comprising hydrogenated hydrocarbonaceous compounds and a hydrogen halide compound to produce an anhydrous stream comprising a hydrogen halide compound and a stream comprising hydrogenated hydrocarbonaceous compounds.

13. A process for treating a halogenated organic stream containing at least one distillable compound having a boiling point lower than the halogenated compounds contained in said halogenated organic stream and selected from the group consisting of an oxygen compound and a nitrogen compound to produce an anhydrous liquid stream comprising hydrogenated hydrocarbonaceous compounds and a hydrogen halide compound which process comprises the steps of:

(a) fractionating said halogenated organic stream containing at least one distillable compound having a boiling point lower than the halogenated compounds contained in said halogenated organic stream and selected from the group consisting of an oxygen compound and a nitrogen compound to produce a halogenated organic stream having a reduced concentration of oxygen and nitrogen compounds and a stream comprising at least one distillable compound having a boiling point lower than the halogenated compounds contained in said halogenated organic stream and selected from the group consisting of oxygen compounds and nitrogen compounds;

(b) contacting said halogenated organic stream having a reduced concentration of oxygen and nitrogen compounds produced in step (a), a hydrogen-rich, gaseous recycle stream and a recycle stream comprising unreacted halogenated organic compounds with a hydrogenation catalyst in a hydrogenation reaction zone at hydrogenation reaction conditions to increase the hydrogen content of said halogenated organic stream and to thereby produce a hydrogen halide compound;

(c) condensing at least a portion of the resulting effluent from said hydrogenation reaction zone to produce said hydrogen-rich, gaseous recycle stream and a liquid stream comprising hydrogenated hydrocarbonaceous compounds and a hydrogen halide compound;

(d) separating said liquid stream comprising hydrogenated hydrocarbonaceous compounds and a hydrogen halide compound to produce an anhydrous stream comprising a hydrogen halide compound and a stream comprising hydrogenated hydrocarbonaceous compounds and unreacted halogenated organic compounds; and (e) separating said stream comprising hydrogenated hydrocarbonaceous compounds and unreacted halogenated organic compounds to produce said recycle stream comprising unreacted halogenated organic compounds and said hydrogenated hydrocarbonaceous stream having a reduced level of halogen.

* * * * *